United States Patent [19]

Kusayanagi et al.

[11] Patent Number: 4,770,763

[45] Date of Patent: Sep. 13, 1988

[54] PROCESS FOR PRODUCING LUBRICANT BASE OIL

[75] Inventors: Sampo Kusayanagi; Takashi Kaimai, both of Saitama, Japan

[73] Assignees: Nippon Mining Co., Ltd.; Kyodo Oil Technical Research Center Co., Ltd., both of Tokyo, Japan

[21] Appl. No.: 65,459

[22] Filed: Jun. 23, 1987

[30] Foreign Application Priority Data

Jun. 23, 1986 [JP] Japan ..... 61-146467

[51] Int. Cl.[4] ..... C10G 71/00

[52] U.S. Cl. ..... 208/18; 208/96; 208/14; 208/57; 208/87; 208/98; 208/99; 585/6.6

[58] Field of Search ..... 208/14, 18, 19, 87, 208/86, 89, 98, 97, 96, 57, 33, 27, 99; 585/6.6

[56] References Cited

U.S. PATENT DOCUMENTS

| | | | |
|---|---|---|---|
| 3,224,955 | 12/1965 | Anderson | 208/18 |
| 3,617,473 | 11/1971 | Lipscomb, II | 208/14 |
| 3,627,673 | 12/1971 | Sproule et al. | 208/14 |
| 3,640,868 | 2/1972 | Rocchini et al. | 208/18 |
| 3,702,817 | 11/1972 | Cummins et al. | 208/18 |
| 3,723,295 | 3/1973 | Kress | 208/87 |
| 3,759,817 | 9/1973 | Mills et al. | 208/14 |
| 3,781,196 | 12/1973 | Thompson | 208/96 |
| 3,953,319 | 4/1976 | Chesluk et al. | 208/14 |
| 4,033,854 | 7/1977 | Ohmori et al. | 208/97 |
| 4,070,297 | 1/1978 | Masunaga et al. | 208/14 |
| 4,170,543 | 10/1979 | Lipscomb, II et al. | 208/89 |
| 4,229,282 | 10/1980 | Peters et al. | 208/87 |
| 4,234,409 | 11/1980 | Schieman et al. | 208/18 |
| 4,259,170 | 3/1981 | Graham et al. | 208/33 |
| 4,521,296 | 6/1985 | Kunihiro et al. | 208/14 |
| 4,542,246 | 9/1985 | Matsunaga et al. | 208/14 |
| 4,608,151 | 8/1986 | Miller | 208/57 |
| 4,636,299 | 1/1987 | Unmuth et al. | 208/87 |
| 4,657,661 | 4/1987 | Miller | 208/97 |
| 4,678,556 | 7/1987 | Hicks et al. | 208/33 |

FOREIGN PATENT DOCUMENTS

| | | | |
|---|---|---|---|
| 60-120793 | 6/1985 | Japan | 208/18 |

OTHER PUBLICATIONS

ASTMD 3238-85 Standard Test for Calculation of Carbon Distribution and Structural Group Analysis of Petroleum Oils by The n-d-M Method.

Gary, "Petroleum Refining", Technology and Economics (2nd Edition), pp. 130-132 (1984).

*Primary Examiner*—Anthony Mc Farlane

*Attorney, Agent, or Firm*—Sughrue, Mion, Zinn, Macpeak & Seas

[57] ABSTRACT

A process for producing a lubricant base oil with low pour point and high aromaticity from a feedstock oil which is either a distillate fraction boiling at 250° C. or above that is obtained from a paraffin base or mixed base crude or a deasphalted oil obtained from a vacuum distillation residual oil of said crude, and process comprising:

(a) the step of bringing said feedstock oil into contact with a hydrofining catalyst in the presence of hydrogen and recovering a hydrofined oil;

(b) the step of dewaxing said hydrofined oil and recovering the dewaxed oil;

(c) the step of subjecting said dewaxed oil to extraction with a solvent having selective affinity for aromatic hydrocarbons so as to separate the feed into the raffinate portion and the extract portion, and removing the solvent from said extract portion to obtain an extract oil; and (d) the step of treating said extract oil by means of contact with a solid adsorbent or sulfuric acid.

10 Claims, 2 Drawing Sheets

PROCESS FOR PRODUCING LUBRICANT BASE OIL

FIELD OF THE INVENTION

The present invention relates to a process for producing a lubricant base oil with good cryogenic characteristics and high aromaticity from a paraffin base crude oil or a mixed base crude oil.

BACKGROUND OF THE INVENTION

Lubricating oils for cryogenic services, such as refrigerating oils and insulating oils, are desirably formed of base oils having low pour points in the range of −30° to −60° C. Refrigerating oils are also required to have good miscibility with a variety of Freon refrigerants at low temperatures. In particular, base oils of high aromaticity that are capable of efficient dissolution of poorly oil-soluble Freon refrigerants such as R-22 and R-502 are desired.

In addition to good flowability at low temperatures, insulating oils which are used in high electric field are required to have the ability to absorb the hydrogen gas that evolves upon partial discharge and this also gives rise to the need for base oils having high aromaticity. Furthermore, base oils for insulating oils are desired to have extremely low viscosities (e.g., from 3.5 to 6 cSt at 40° C.). For other applications such as solvents for rubbers and metal soaps, base oils having high aromaticity and boiling at temperatures of from about 250° to 500° C. are desired.

Lubricant base oils having the performance characteristics described above have conventionally been produced from naphthene base crudes or synthetic oils with high aromaticity have been used to attain the same purpose. But today naphthene base crudes are no longer easily available and the production of synthetic oils with high aromaticity is costly. Under these circumstances, it is required to establish a technology that is capable of producing the desired lubricant base oils from paraffin base or mixed base crudes but no satisfactory technique has yet been proposed.

As is well known, lubricant base oils are typically produced by combinations of such techniques as hydrofining, solvent extraction, dewaxing with a solvent or by hydrocracking, treatment with activated clay, and sulfuric acid treating. In the step of solvent extraction, a suitable extraction solvent such as furfural is used and the raffinate portion of the feed is recovered to be subjected to subsequent steps of refining. Methods based on the approach are described in Japanese Patent Application (OPI) Nos. 164109/1983, 101804/1985 and 120793/1985 (the term "OPI" as used herein means an unexamined published Japanese patent application) and U.S. Pat. Nos. 3,640,868, 3,617,473, and 3,759,817. A method involving the recovery of the extract portion resulting from solvent extraction is described in Japanese Patent Publication No. 24395/1982; according to this method, the extract is recovered in the first stage of extraction and subjected to the second stage of extraction, from which the raffinate is recovered and passed through the steps of dewaxing and hydrofining. This method is described as being capable of producing oils with high aromaticity. However, the pour point of the product oil, even if it is wax free, is not lower than the temperature to which the raffinate was cooled to cause wax crystallization.

Japanese Patent Publication No. 3321/1976 discloses a process in which the extract oil is hydrofined with an Ni-W catalyst and mixed with a raffinate oil prior to dewaxing. The oil produced by this process does not have high aromaticity and no significant drop in the pour point is attainable by the dewaxing step.

If lubricant fractions are subjected to hydrofining or dewaxing under rigorous conditions, base oils having pour points of from about −10° to −30° C. and n-d-M ring analysis values of from about 4 to 8% $C_A$ are typically obtained but in practical applications it is difficult to produce base oils having much lower pour points and yet high aromaticity from paraffin base or mixed base crudes. Refrigerating oils that are produced from naphthene base crudes and which have viscosities of from 10 to 100 cSt at 40° C. are known to have n-d-M ring analysis values of from about 2 to 14% $C_A$ and pour points of about −35° C.

SUMMARY OF THE INVENTION

The present invention has been accomplished in order to solve the aforementioned problems of the prior art and provides a process by which a lubricant base oil having superior cryogenic characteristics as manifested by a pour point of −30° C. or below, preferably −35° C. or below, and high aromaticity as demonstrated by an n-d-M ring analysis value of at least 10% $C_A$, preferably at least 15% $C_A$, and more preferably at least 18% $C_A$, can be efficiently produced from an easily available paraffin base or mixed base crude.

The process of the present invention is characterized by a sequence of the steps of: hydrotreating either a lubricant fraction from a paraffin base or mixed base crude or a deasphalted oil obtained by deasphalting said crude oil; dewaxing said hydrotreated oil; subjecting the resulting dewaxed oil to extraction with a solvent having selective affinity for aromatic hydrocarbons so as to separate the feed into the raffinate and extract portions; recovering an extract oil from the extract portion; and treating the recovered extract oil with a solid adsorbent or sulfuric acid.

The individual unit operations of this process are known and have been practiced in the art. The important features of the process are the order of these operations and the recovery of the extract portion in the step of solvent extraction, and it is particularly important for the purposes of the present invention that the dewaxed oil is subjected to extraction so as to recover an extract oil.

DETAILED DESCRIPTION OF THE INVENTION

Figure 1:
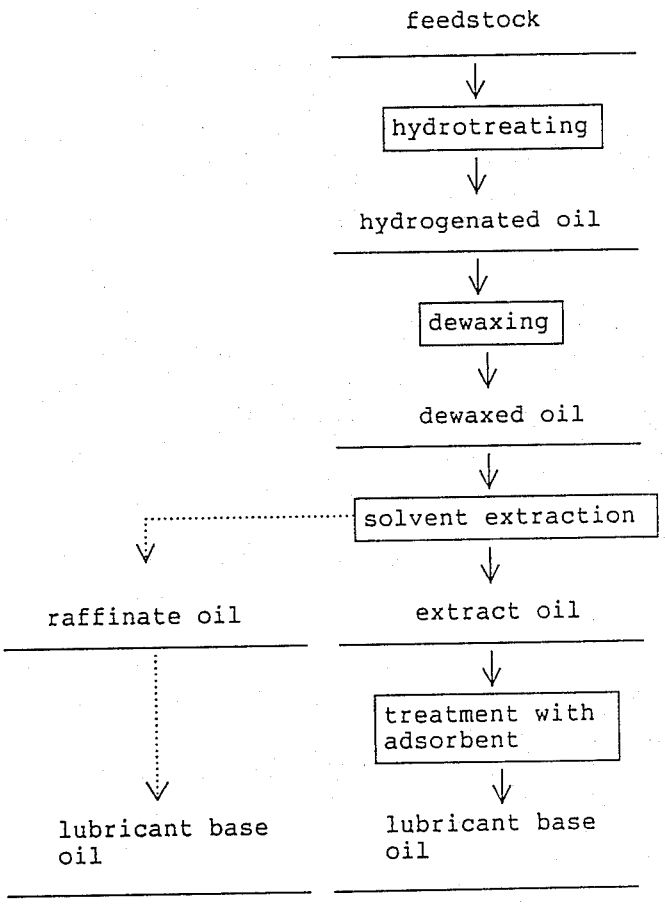
FIGS. 1 and 2 are two flowsheets for producing a lubricant base oil by the process of the present invention.

The crude oil used in the present invention is any of the paraffin base or mixed base crudes that are produced in the Middle East, China and South Asia. In the process of the present invention, either a lubricant fraction that is recovered from one or more of these crude oils or a deasphalted oil that is obtained by deasphalting these crude oils is used as feedstock producing a lubricant base oil. Atmospheric residues of these crude oils are further distilled under vacuum to recover distillate oils boiling in the temperature ranges of from about 250° to 400° C., from about 350° to 500° C. and from about 450° to 650° C.; alternatively, the atmospheric residues are deasphalted, typically with propane, and the resulting deasphalted oil is used as the feedstock. The boiling point and viscosity of the feed used in the present invention are not limited to any particular values but suitable values of viscosity may be selected from the range of from 5 to 500 cSt at 40° C. If necessary, the above-mentioned fractions of the vacuum distillate may be further distilled for adjustment of boiling point range or viscosity level. A suitable feedstock may be selected from among such modified fractions.

In order to attain the desired lubricant base oil of the present invention, the feedstock described above is subjected to refining treatment by the following procedures. In the first step, the feedstock is hydrotreated to obtain a hydrogenated oil. In the step of hydro-treatment, any of the known hydrofining catalysts customarily used in the refining of heavy oils or lubricating oils, such as those comprising one or more of from about 0.1 to 10 wt % Ni, Co, Mo, W, etc. supported on carriers such as silica, alumina or silica-alumina, may be employed, and a specific example is Co-Mo-Ni base Ketjenfine 124. The conditions of hydrofining should be such that yields of from 90 to 97% can be attained with minimum occurrence of hydrocracking while ensuring satisfactory desulfurization and denitrification. The cracking reaction is not preferable since it causes lower yields and leads to the production of refined oils with reduced viscosity. In order to avoid the cracking reaction, the hydrogen pressure for hydrofining is selected from the range of from about 30 to 150 kg/cm$^2$G. For treatment of feedstocks having comparatively low viscosity, hydrogen pressures of from 30 to 80 kg/cm$^2$G are suitable, and for heavy feedstocks with higher viscosities, pressures of from 80 to 120 kg/cm$^2$G are typically used. The temperature for hydrofining is usually selected from the range of from about 300° to 450° C. In order to minimize the cracking reaction and to achieve satisfactory desulfurizing and denitrifying reactions, the lower ends of the temperature range (from 340° to 380° C.) and the liquid hourly space velocity (LHSV) range (from 0.2 to 5 hr$^{-1}$) may be selected, The finally obtained oil will have improved resistance to oxidation if hydrofining is performed under such conditions that the hydrogenated oil has a sulfur content of no more than 1 wt %, preferably no more than 0.5 wt %, and a nitrogen content of no more than 300 ppm, preferably no more than 200 ppm.

Before hydrotreating, the feedstock oil may be subjected to extraction with a suitable solvent such as furfural or phenol under mild conditions and from about 10 to 30% of the extract portion is removed while the raffinate portion is recovered in a yield of from 90 to 70%. The recovered raffinate portion is freed of the solvent to obtain a raffinate oil. Since substantial amounts of unstable components and nitrogen content have been removed from this raffinate oil, it can be hydrofined with a reduced load of catalyst, which leads to a prolonged catalyst life. Other advantages that result from the use of the raffinate oil which has been obtained by performing solvent extraction under mild conditions before hydrotreating are the decrease in the temperature for subsequent hydrotreating and the increase in LHSV. Furfural and any other known solvent may be employed and a suitable temperature can be selected from the range of from 40° to 80° C. It should, however, be noted that the solvent extraction prior to hydrofining introduces some complexity to the overall process and may be omitted if satisfactory results can be attained by subsequent operations without performing this solvent extraction.

The hydrogenated oil or hydrogenated raffinate oil thus obtained is subjected to the next treatment, i.e., dewaxing. Dewaxing may be accomplished by a common method, namely, with the aid of a solvent or by hydrogenation. In the first method, acetone or a mixed solvent of methyl ethyl ketone and toluene, that are mixed with the hydrogenated oil or hydrogenated raffinate oil in a volume ratio of from 2:1 to 3:1, is cooled to a temperature between −10° and −20° C. and optionally to a lower temperature of −30° C., and the crystallizing wax is filtered off to recover a dewaxed oil. The cooling temperature may be determined according to the pour point of the desired oil. Generally speaking, cooling to −20° C. and subsequent dewaxing provides a dewaxed oil having a pour point in the range of from about −15° to −17.5° C. and the extract oil recovered from the subsequent step of solvent extration to be described below will have a pour point in the range of from about −25° to −50° C. In dewaxing by hydrogenation, a dewaxed oil is obtained by selective decomposition and removal of the wax content in a hydrogen atmosphere in the presence of a suitable catalyst such as a synthetic zeolite.

The conditions for dewaxing are preferably selected such that the resulting dewaxed oil will have a pour point of −10° C. or below but in practice the pour point of dewaxed oil may be determined according to the specific use of the desired lubricant base oil. It should however be noted that there is no need to employ any rigorous conditions for the specific purpose of producing a dewaxed oil having a significantly reduced pour point because the extract oil to be obtained in the subsequent step of solvent extraction has an unexpectedly lowered pour point.

According to the present invention, the dewaxed oil is subjected to extraction with a solvent having selective affinity for aromatic hydrocarbons, or a solvent that is capable of selective extraction of aromatic hydrocarbons. Illustrative solvents that may be used in this step include furfural, phenol and N-methylpyrrolidone, which may be used either independently or in admixture. In the step of solvent extraction, the dewaxed oil may be brought into contact with a suitable solvent at a temperature of from 60° to 120° C. in a solvent to oil ratio of from 1:1 to 3:1 on a volume basis. As a result of this contact, the feed is separated into the raffinate portion and the extract portion, which is recovered and freed of such that the yeild of extract oil recovered will be in the solvent to produce a recoverable extract oil. The conditions of solvent extraction are desirably selected such that the yield of extract oil recovered will be in the range of from 5 to 40 vol %, preferably from 5 to 30 vol %, more preferably from 5 to 25 vol %. The yield of extract oil relates to its pour point and aromatic content; if the yield is excessive, the depression of pour point will be reduced and the aromatic content decreases, with the result that the desired effects of the present invention are not attainable.

The treatment of solvent extraction described above will produce an extract oil having a very low pour point. For example, by performing solvent extraction on a dewaxed oil having a pour point of from −10° to −15° C., an extract oil with a pour point in the range of from −30° to −60° C. can be readily attained.

According to the present invention, dewaxing followed by solvent extraction will produce an unexpectedly large drop in the pour point of the extract oil obtained. For example, the extract oil attained by solvent extraction of a dewaxed oil can sometimes have a pour point that is lower than that of the dewaxed oil by as much as from 30° to 40° C. On the other hand, if the hydrofined oil is first subjected to solvent extraction and if the recovered extract oil is dewaxed by a similar method using a solvent, the pour point of the dewaxed oil cannot be lower than the cooling temperature used to crystallize. In addition, the crystallizing wax is difficult to separate by filtration. Even if the other method, namely, hydrogenation, is used to achieve dewaxing, the impurities in the extract oil will cause a substantial drop in the performance of the catalyst used and the efficiency of dewaxing attainable is also very low.

Such a drop in pour point is attained only when a feedstock oil is treated by the above-described sequence of hydrofining, dewaxing of the resulting hydrogenated oil or hydrogenated raffinate oil, and extraction with a specified solvent. This sequence of specified steps also provides an extract oil having an n-d-M ring analysis value of at least 10% CA, typically between 15 and 50% CA. In addition, the extract oil has a viscosity index of from 1 to 65, which is equal to or higher than that of the base oil prepared from a naphthene base crude.

The extract oil obtained by solvent extraction treatment described above is subsequently treated with a solid adsorbent (e.g., activated clay) or sulfuric acid to remove the nitrogenous component and to provide further improved color stability. In the present invention, the raffinate oil separated in the step of solvent extraction may be refined by routine procedures to yield a product that can be used as a general-purpose lubricant base oil.

As described on the foregoing pages, the process of the present invention comprises hydrotreating a feedstock oil, optionally preceded by solvent extraction, then dewaxing the resulting hydrogenated oil, and subjecting the dewaxed oil to solvent extraction. By this sequence of treatments, the present invention successfully produces a base oil with high aromaticity that has good cryogenic characteristics.

The following Examples and Comparative Example are provided for the purpose of further illustrating the present invention but are in no sense to be taken as limiting.

EXAMPLE 1

An atmospheric distillation residual oil of Arabian light oil was further distilled under vacuum to obtain distillate oil A with a boiling point of from 250° to 400° C., distillate oil B with from 340° to 520° C., and distillate oil C with from 400° to 650° C., which were respectively used as feedstocks.

Distillate oil A was refined by the following sequence of operations according to the flowsheet shown in accompanying FIG. 1. First, distillate oil A was hydrotreated by being supplied into a high-pressure hydrogenating column packed with a Co-Mo base hydrotreating catalyst; the hydrogen pressure was 100 kgf/cm$^2$G, the temperature was from 360° to 370° C., and the liquid hourly space velocity (LHSV) was 1.0 hr$^{-1}$. As a result, a hydrogenated oil A was a sulfur content of 0.03 wt % was obtained.

One part by volume of the hydrogenated oil A was mixed with two parts by volume of a mixed solvent of toluene/methyl ethyl ketone (50:50 on a volume basis). The resulting mixture of oil and solvent was cooled to −20° C. and held at that temperature for half an hour. The crystallizing wax content was filtered off through a filter cloth and dewaxed oil A recovered. This oil had a pour point of −15° C. The dewaxed oil was subjected to solvent extraction at from 60° to 80° C. in a rotary disk countercurrent-contact extracting column which was fed with 1 part by volume of the oil and 2 parts by volume of furfural. The extract portion and the raffinate portion were recovered and extract oil A was obtained by separating furfural from the extract portion through vacuum evaporation. The yield of the extract oil A to the dewaxed oil was 15 vol %.

The extract oil A was subjected to adsorption treatment by adding 2.5 wt % activated clay to the oil and agitating the mixture. The resulting lubricant base oil A had the properties shown in Table 1 below, which also lists the properties of the dewaxed oil A.

TABLE 1

| Properties | Lubricant Base Oil A | Dewaxed Oil A |
|---|---|---|
| Specific gravity | 0.9454 | 0.8704 |
| Pour point (°C.) | −47.5 | −15.0 |
| Viscosity (cSt at 40° C.) | 9.4 | 8.4 |
| Sulfur content (wt %) | 0.09 | 0.02 |
| Nitrogen content (ppm) | 14 | 2 |
| n-d-M Ring analysis value | | |
| % $C_A$ | 44.5 | 14.6 |
| % $C_N$ | 11.7 | 25.1 |
| % $C_P$ | 43.8 | 60.3 |

EXAMPLE 2

Figure 2:
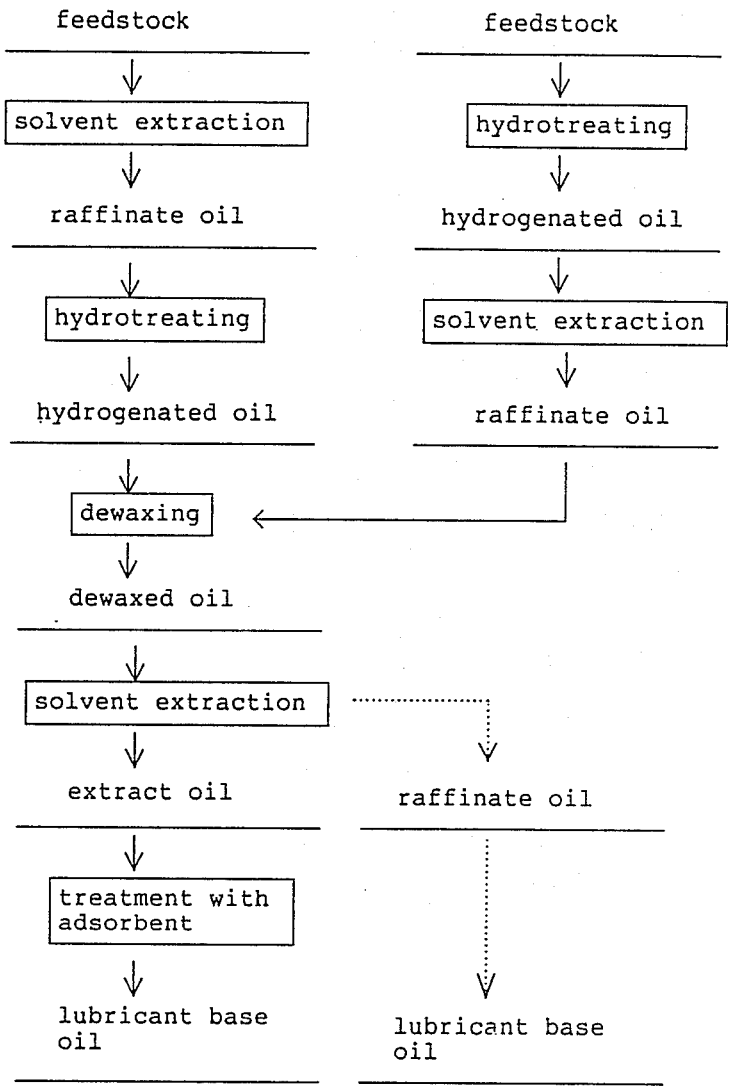

Distillate oils B and C shown in Example 1 were refined by the following sequence of operations according to the flow sheet shown in accompanying FIG. 2. First, each of the distillate oils was subjected to solvent extraction at from 60° to 80° C. in a rotary disk countercurrent-contact extracting column which was fed with 1 part by volume of the oil and 0.5 part by volume of furfural. The recovered raffinate portion was freed of the solvent under vacuum to obtain raffinate oil B or C.

In the next step, using a hydrogenating column packed with the same catalyst as identified in Example 1, raffinate oil B was hydrotreated at a hydrogen pressure of 100 kgf/cm$^2$G and at a temperature of from 370° to 375° C., and raffinate oil C hydrotreated at a hydrogen pressure of 100 kgf/cm$^2$G and at a temperature of from 380° to 385° C. As a result, hydrogenated raffinate oils B and C each having a sulfur content of 0.1 wt % were obtained.

Each of the hydrogenated raffinate oils was dewaxed by the same procedures as shown in Example 1, thereby producing dewaxed oils B and C each having a pour point of −15° C. Each of the dewaxed oils was subjected to solvent extraction at from 80° to 100° C. in the same type of extracting column as shown in Example 1 which was fed with 1 part by volume of the oil and 2.5 parts by volume of furfural; the feed was separated into the raffinate portion and the extract portion which was freed of the solvent to obtain extract oil B or C.

The yields of the recovered extract oils to the dewaxed oils were as follows: oil B, 13.0 vol %; oil C, 12.0 vol %.

The two extract oils were subjected to adsorption treatment by adding 5.0 wt % activated clay to the oils and agitating the mixtures. The resulting lubricant base oils B and C had the properties shown in Table 2 below, which also lists the properties of dewaxed oils B and C.

TABLE 2

| Properties | Dewaxed Oil B | Dewaxed Oil C | Lubricant Base Oil B | Lubricant Base Oil C |
|---|---|---|---|---|
| Specific gravity | 0.8656 | 0.8856 | 0.9007 | 0.9287 |
| Pour point (°C.) | −15.0 | −15.0 | −35.0 | −30.0 |
| Viscosity (cSt at 40° C.) | 26.7 | 90.2 | 34.34 | 128.4 |
| Sulfur content (wt %) | 0.11 | 0.12 | 0.20 | 0.28 |
| Nitrogen content (ppm) | 12 | 49 | 8 | 13 |
| n-d-M Ring analysis value | | | | |
| % $C_A$ | 6.8 | 8.7 | 15.1 | 20.9 |
| % $C_N$ | 25.6 | 24.3 | 28.9 | 24.9 |
| % $C_P$ | 67.6 | 67.0 | 56.1 | 54.1 |

The following Comparative Example is given in order to show the results of performing a sequence of refining steps without following the order specified by the present invention.

COMPARATIVE EXAMPLE

Hydrogenated oil A was prepared as in Example 1. Using a rotary disk countercurrent-contact extracting column, this oil was subjected to solvent extraction in the same manner as shown in Example 1, and the resulting extract portion was freed of the solvent to obtain an extract oil. One part by volume of this extract oil was mixed with 2 parts by volume of a mixed solvent of toluene/methyl ethyl ketone (50:50 on a volume basis). The resulting oil/solvent mixture was cooled to −20° C. and held at that temperature for half an hour. The crystallizing wax content was filtered off through a filter cloth to obtain dewaxed oil A'. The dewaxed oil A' was subjected to adsorption treatment with 5.0 wt % activated clay so as to obtain lubricant base oil A'. The properties of this base oil are shown in Table 3. In this Comparative Example, the rate of filtration through the filter cloth was about one half the value attained in Example 1, and the yield of dewaxed oil was about 10% lower than the value achieved in Example 1.

TABLE 3

| Properties | Lubricant Base Oil A' |
|---|---|
| Specific viscosity | 0.9431 |
| Pour point (°C.) | −15.0 |
| Viscosity (cSt at 40° C.) | 9.2 |
| Sulfur content (wt %) | 0.08 |
| Nitrogen content (ppm) | 2 |
| n-d-M Ring analysis value | |
| % $C_A$ | 41.5 |
| % $C_N$ | 12.3 |
| % $C_P$ | 46.2 |

EXAMPLE 3

This Example shows the functional characteristics of the lubricant base oils produced by the process of the present invention. Lubricant base oils A (Example 1), B and C (Example 2) and A' (Comparative Example) were subjected to measurement of their functional characteristics as refrigerating oils. The results are shown in Table 4, which also lists the results of same measurement as conducted on a commercial refrigerating oil made from naphthene base crude.

TABLE 4

| Characteristics | Lubricant Base Oil: Samples of the Invention A | B | C | Reference Sample Commercial Product | Comparative Sample A' |
|---|---|---|---|---|---|
| Pour point (°C.) | −47.5 | −35.0 | −30.0 | −37.5 | −20.0 |
| Viscosity index | 3 | 62 | 42 | −10 | 5 |
| Total acid number (mg KOH/g) | 0.01 | 0.01 | 0.01 | 0.01 | 0.01 |
| Floc point (°C.) | −70 | −70 | −70 | −57.5 | −30 |
| Viscosity (cSt at 40° C.) | 9.4 | 34.3 | 128.4 | 29.3 | 9.2 |
| Critical dissolution point (°C.) oil:refrigerant | | | | | |
| 2:8 | −46 | −23 | −3 | −11 | −36 |
| 6:4 | −50 | −33 | −13 | −31 | −41 |
| 8:2 (refrigerant: R-22) | −70 ↓ | −47 | −22 | −58 | −60 |
| n-d-M Ring analysis value, % $C_A$ | 44.5 | 15.1 | 20.9 | 13.8 | 41.5 |

EXAMPLE 4

This Example shows the functional characteristics of the lubricant base oil produced by the process of the present invention. Lubricant base oils A (Example 1) and A' (Comparative Example) were subjected to measurement of their functional characteristics as insulating oils. The results are shown in Table 5, which also lists the result of same measurement as conducted on a commercial insulating oil made from naphthene base crude.

TABLE 5

| Characteristics | Lubricant Base Oil: Sample of the Invention A | Reference Sample Commercial Product | Comparative Sample A' |
|---|---|---|---|
| Pour point (°C.) | −47.5 | −40.0 | −15.0 |
| Viscosity (cSt at 40° C.) | 9.4 | 8.4 | 9.2 |
| Total acid number (mg KOH/g) | 0.01 | 0.01 | 0.01 |
| Corrosive Sulfur (140° C. × 19 hr.) | negative | negative | negative |
| Breakdown voltage (KV) | 70.3 | 68.1 | 69.5 |
| Volume resistivity (Ω-cm at 80° C.) | $1.5 \times 10^{15}$ | $3.1 \times 10^{14}$ | $1.0 \times 10^{15}$ |
| Loss tangent (% at 80° C.) | 0.01 | 0.02 | 0.01 |
| Specific dispersion (25° C.) | 147 | 115 | 145 |
| $H_2$ gas absorption* | 128 | 28 | 120 |
| n-d-M Ring analysis value | 44.5 | 11.7 | 41.5 |

TABLE 5-continued

| Characteristics | Lubricant Base Oil | | |
|---|---|---|---|
| | Sample of the Invention A | Reference Sample Commercial Product | Comparative Sample A' |
| % $C_A$ | | | |

*The $H_2$ gas absorption was measured in the following manner. That is, into a sample vessel of a Thornton type tester, 25 ml of the oil was charged, a hydrogen gas was blown into the oil for saturation, and the resulting oil was introduced to anelectrode portion of the tester. The electrode portion was kept at 50° C. ± 0.5° C., and a sine wave with a voltage of 8 KV was applied between the electrodes. After the application, a differential pressure (mm) shown by a manometer was read every 10 minutes, and that as measured after 120 minutes was taken.

As Tables 1 and 2 show, according to the present invention, dewaxed oils having a pour point of −15° C. can be converted into lubricant base oils having the desired flowability at low temperatures (−30° C. > pour point > −50° C.). As Table 4 shows, the base oils produced in accordance with the present invention have good miscibility with a Freon refrigerant because refrigerating oils empoying such base oils had very low values of critical dissolution temperature which is a measure of the miscibility with refrigerant R-22. The base oil prepared in the Comparative Example without employing the process of the present invention had good miscibility with a Freon refrigerant but they had very high pour and floc points even in comparison with the commercial product. If a refrigerating oil employing this comparative base oil were put through refrigerating cycles, it would not be able to perform satisfactorily because of the occurrence of such troubles as the clogging of expansion valves.

As Table 5 shows, the insulating oil employing one of the base oils prepared in accordance with the present invention had electrical characteristics (i.e., breakdown voltage, volume resistivity and loss tangent) comparable to those of the commercial product. However, the specific dispersion and $H_2$ gas absorption (two parameters that show insusceptibility to corona discharge in a high electric field) of the former insulating oil were extremely higher than the values for the commercial product, suggesting the suitability of the former oil for use in higher-voltage electric machines. The base oil prepared in the Comparative Example had good anti-corona discharge characteristics but it had such a high pour point (> −27.5° C. which is the upper limit specified by JIS C2320) that it would not be suitable for use in commercial applications.

As will be understood from the foregoing description, the present invention has the marked advantage that it provides an effective method for producing a lubricant base oil with high aromaticity and superior cryogenic characteristics from a paraffin base or mixed base crude.

While the invention has been described in detail and with reference to specific embodiments thereof, it will be apparent to one skilled in the art that various changes and modifications can be made therein without departing from the spirit and scope thereof.

What is claimed is:

1. A process for producing a lubricant base oil having a pour point of 20° C. or less and an n-d-M ring analysis value of at least 10% $C_A$ from a feedstock oil which is selected from the qroup consisting of a distillate fraction boiling at 250° C. or above obtained from a paraffin base or mixed base crude and a deasphalted oil obtained from a vacuum distillation residual oil of said crude, said process comprising:

(a) the step of bringing said feedstock oil into contact with a hydrofining catalyst in the presence of hydrogen under conditions to minimize hydrocracking and recovering a hydrofined oil;

(b) the step of dewaxing said hydrofined oil and recovering the dewaxed oil;

(c) the step of subjecting said dewaxed oil to extraction with a solvent having selective affinity for aromatic hydrocarbons so as to separate the feed into a raffinate portion and an extract portion, and removing the solvent from said extract portion to obtain an extract oil; and (d) the step of treating said extract oil by means of contact with a solid adsorbent or sulfuric acid to stabilize said extract oil.

2. A process according to claim 1, wherein the base oil to be produced has a pour point in the range of from −30° to −50° C. and an n-d-M ring analysis value of at least 15% $C_A$.

3. A process according to claim 1, wherein the base oil produced has an n-d-M ring analysis value in the range of from 20 to 45% $C_A$.

4. A process according to claim 1, wherein the hydrofined oil has a sulfur content of no more than 1 wt % and a nitrogen content of no more than 300 ppm.

5. A process according to claim 1, wherein the dewaxed oil has a pour point of no higher than −10° C.

6. A process according to claim 1, wherein the dewaxed oil is subjected to solvent extraction so as to attain the extract oil in a yield of from 5 to 40 vol %.

7. A rocess according to claim 1, wherein the dewaxed oil is subjected to solvent extraction so as to attain the extract oil in a yield of from 5 to 30 vol %.

8. A process according to claim 1, wherein the feedstock oil, prior to step (a), is subjected to extraction with a solvent having selective affinity for aromatic hydrocarbons and raffinate portion of 70 to 90% is obtained, and the raffinate portion, after removal of from 10 to 30% of the extraction portion, is subjected to treatments by steps (a), (b), (c) and (d).

9. A process according to claim 1, wherein said hydrotreating is conducted under a hydrogen pressure of from 30 to 80 kg/cm$^2$G.

10. A process according to claim 1, wherein said hydrotreating is conducted under a hydrogen pressure of from 80 to 120 kg/cm$^2$G.

* * * * *